US012018545B2

(12) United States Patent
Zhong et al.

(10) Patent No.: US 12,018,545 B2
(45) Date of Patent: Jun. 25, 2024

(54) SINGLE SLIP FRAC TOOL

(71) Applicant: Halliburton Energy Services, Inc., Houston, TX (US)

(72) Inventors: Xiaoguang Allan Zhong, Singapore (SG); Shobeir Pirayeh Gar, Carrollton, TX (US); Daniel Keith Moeller, Carrolton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/565,199

(22) Filed: Dec. 29, 2021

(65) Prior Publication Data

US 2023/0203912 A1 Jun. 29, 2023

(51) Int. Cl.
*E21B 33/129* (2006.01)
*E21B 33/128* (2006.01)

(52) U.S. Cl.
CPC ..... *E21B 33/129* (2013.01); *E21B 33/128* (2013.01)

(58) Field of Classification Search
CPC .. E21B 33/128; E21B 33/134; E21B 33/1208; E21B 33/1291; E21B 33/1292
See application file for complete search history.

(56) References Cited

U.S. PATENT DOCUMENTS 5,701,959 A * 12/1997 Hushbeck ..... E21B 33/1216 166/387
6,394,180 B1 5/2002 Berscheidt et al.
7,740,079 B2 6/2010 Clayton et al.
8,047,279 B2 11/2011 Barlow et al.
8,113,276 B2 * 2/2012 Greenlee ..... E21B 23/006 166/216
8,403,036 B2 * 3/2013 Neer ..... E21B 33/1216 166/134
8,770,276 B1 * 7/2014 Nish ..... E21B 33/1291 166/138
8,875,799 B2 * 11/2014 Smith ..... E21B 33/1216 166/387
9,580,981 B2 2/2017 Zhong et al.
9,835,003 B2 * 12/2017 Harris ..... E21B 33/1208
10,233,720 B2 * 3/2019 Tse ..... E21B 33/129
10,428,616 B2 10/2019 Dirocco
11,365,600 B2 * 6/2022 Greenlee ..... E21B 33/129
2013/0186649 A1 * 7/2013 Xu ..... E21B 23/00 166/382

(Continued)

OTHER PUBLICATIONS

Halliburton Catalog, Completion Tools, pp. 5-24 through 5-34 (undated but admitted to be prior art).

(Continued)

*Primary Examiner* — Daniel P Stephenson
(74) *Attorney, Agent, or Firm* — McAfee & Taft

(57) ABSTRACT

A frac plug has a bottom shoe, a single slip ring supported by the bottom shoe, a slip wedge positioned above the slip ring and axially movable relative to the slip wedge, a radially outwardly expandable sealing element supported by the slip wedge and a deformable backup shoe fixed to the sealing element. The deformable backup shoe has a cap covering at least a portion of a top surface of the sealing element and an outer leg extending along at least a portion of an outer surface of the sealing element. A ball seat is insertable into the radially outwardly expandable sealing element.

19 Claims, 13 Drawing Sheets

(56) References Cited

U.S. PATENT DOCUMENTS

| | | | | |
|---|---|---|---|---|
| 2014/0311752 | A1* | 10/2014 | Streich | E21B 33/134 166/376 |
| 2015/0226047 | A1* | 8/2015 | Robb | E21B 33/1285 166/185 |
| 2017/0260825 | A1* | 9/2017 | Schmidt | E21B 33/12 |
| 2018/0245422 | A1 | 8/2018 | Fripp et al. | |
| 2018/0363409 | A1 | 12/2018 | Frazier | |
| 2019/0162044 | A1* | 5/2019 | Dirocco | E21B 23/06 |
| 2019/0292874 | A1 | 9/2019 | Saeed | |
| 2019/0352998 | A1* | 11/2019 | Wolf | E21B 33/128 |
| 2020/0115988 | A1 | 4/2020 | Wilcox et al. | |
| 2020/0157914 | A1* | 5/2020 | Graham | E21B 43/26 |
| 2021/0054704 | A1* | 2/2021 | Merron | E21B 33/124 |
| 2021/0293113 | A1* | 9/2021 | Pelto | E21B 33/12 |
| 2022/0120151 | A1 | 4/2022 | Jacob | |
| 2023/0203912 | A1* | 6/2023 | Zhong | E21B 33/128 166/123 |

OTHER PUBLICATIONS

Halliburton Catalog, "Liner Hanger Systems," Completion Tools, pp. 7-1 through 7-22 (undated but admitted to be prior art).

* cited by examiner

SINGLE SLIP FRAC TOOL

BACKGROUND

Fracturing plugs, or "frac plugs" are designed to set inside a wellbore and divide the wellbore into zones. Frac plugs generally act like one-way valves to allow flow in one direction. Single slip frac plugs used in wellbores only take differential pressure from above, thus no need for bi-directional slips. When a setting tool is removed prior art single slip frac plugs rely solely on the friction between the element and casing inner diameter. There are times when the friction force alone may not be enough to hold the frac plug in place.

BRIEF DESCRIPTION OF THE DRAWINGS

FIG. 6 is a cross section of the frac plug of FIG. 5 in a set position.

FIG. 9 is a cross section of the frac plug of FIG. 8 in a set position.

FIG. 13 is a cross section of the frac plug of FIG. 11 in a set position with the setting tool removed.

DESCRIPTION OF A PREFERRED EMBODIMENT

Figure 1:
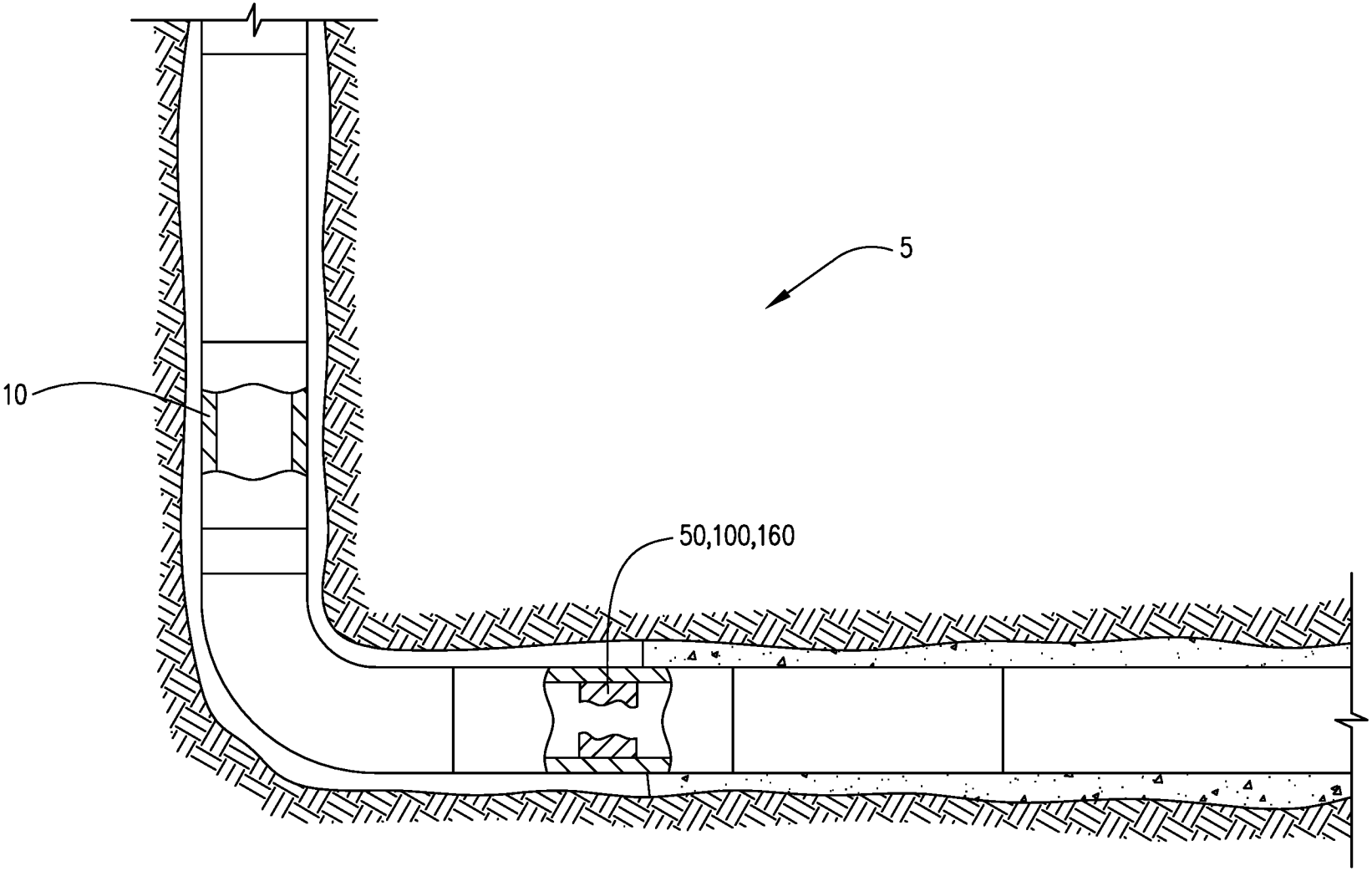
FIG. 1 is a schematic of a cased well with a frac plug therein.
Figure 2:
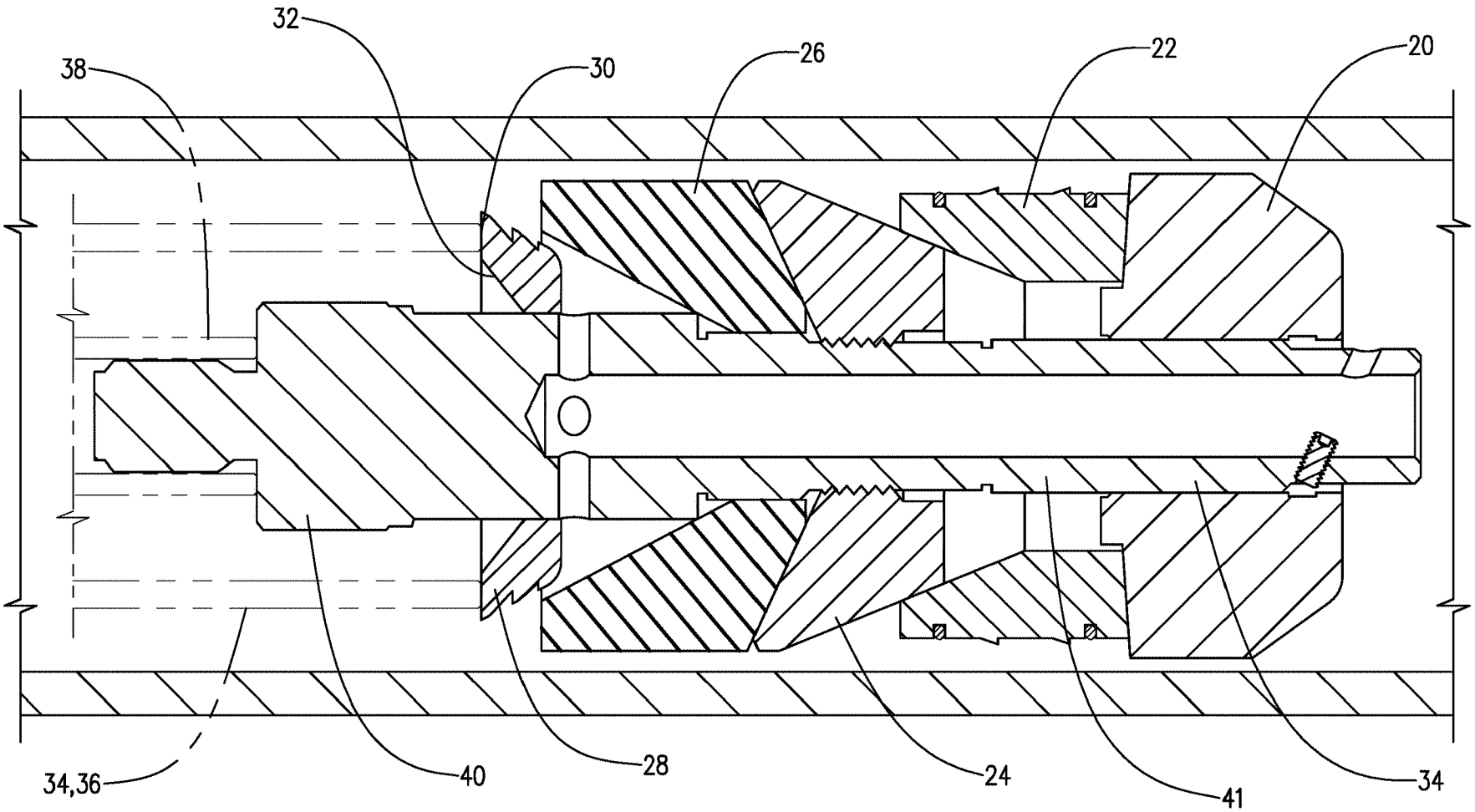
FIG. 2 PRIOR ART
FIG. 2 is a cross section of a prior art frac plug.
Figure 3:
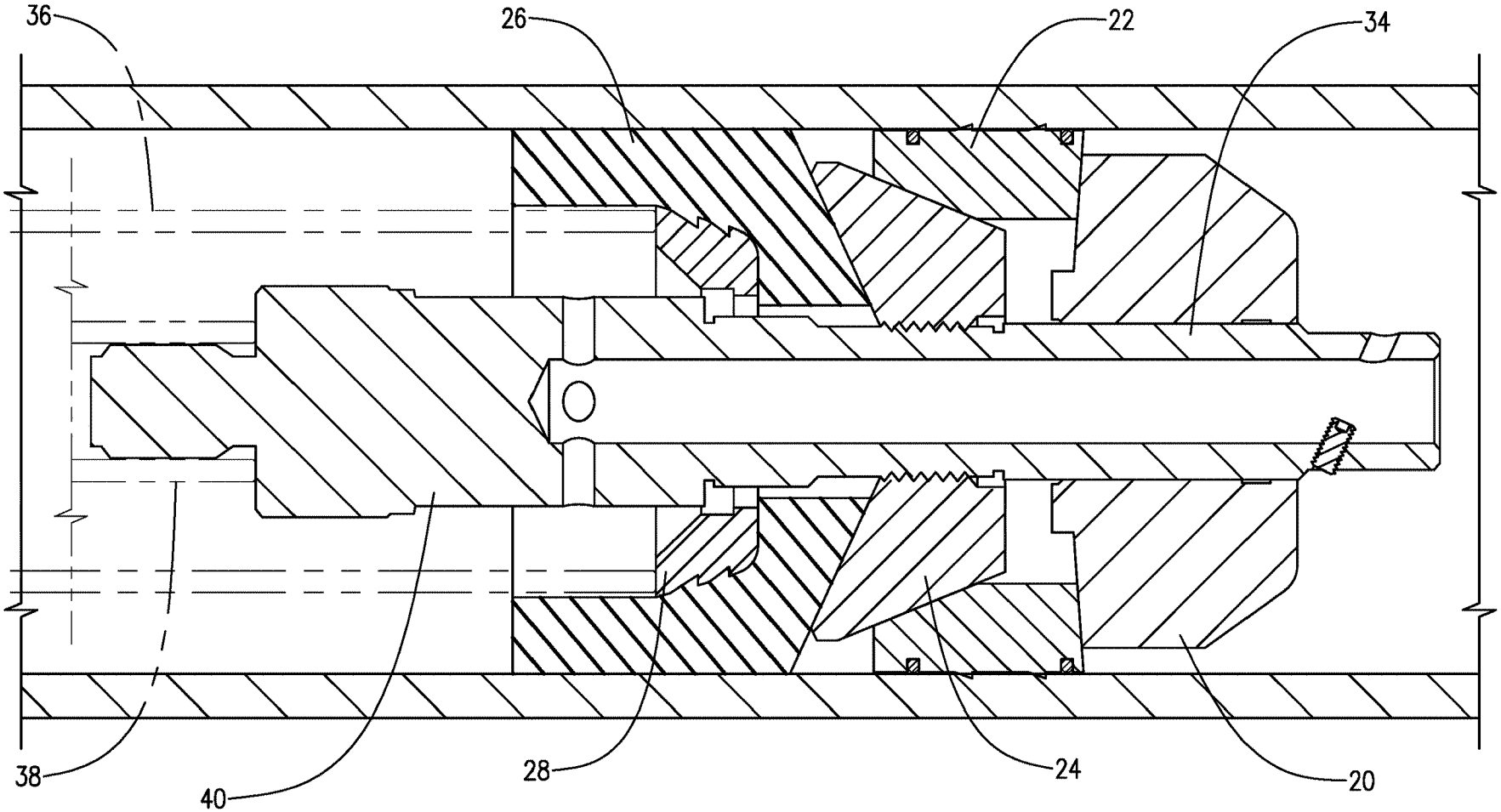
FIG. 3 PRIOR ART
FIG. 3 is a cross section of the prior art frac plug in a set position.
Figure 4:
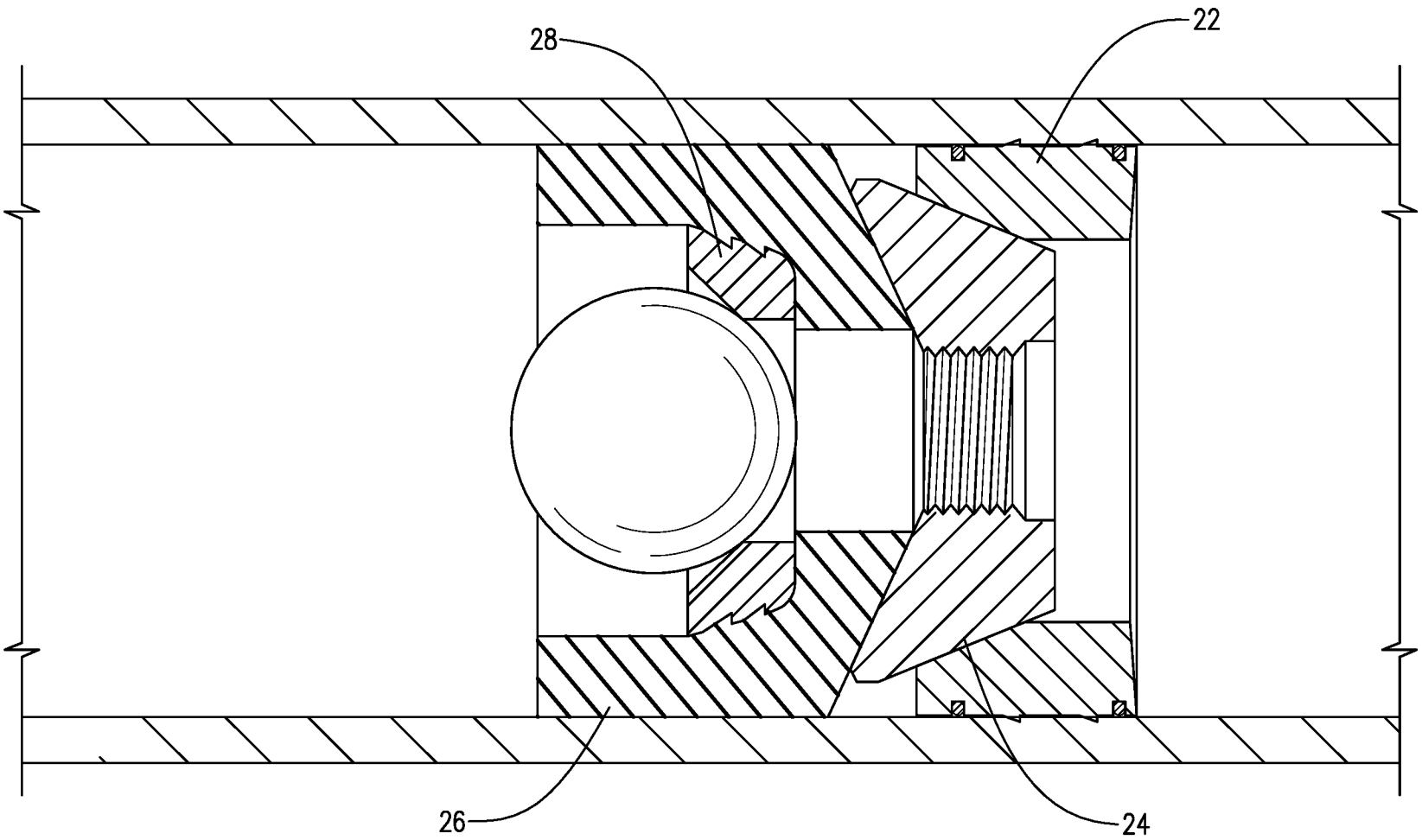
FIG. 4 PRIOR ART
FIG. 4 is a cross section of the prior art frac plug in a set position with the setting tool removed.

FIG. 1 schematically shows a well 5 with a casing 10 disposed therein. FIGS. 2-4 show cross sections of a prior art single slip frac plug. Prior art frac plug 15 comprises a bottom shoe 20, a slip assembly 22 supported thereon, a slip wedge 24, and a sealing element 26 supported by the slip wedge 24. A ball seat 28 is positioned in sealing element 26 in a set position of the prior art frac plug 15. Ball seat 28 has top surface 30 and inner surface 32, which is generally conically shaped. A setting tool 34 is connected at a lower end thereof to bottom shoe 20. An inner sleeve, or mandrel 38 of the setting tool 34 is connected to a head or adapter 40 and a setting sleeve 36 which is an outer sleeve 36 engages ball seat 28. An upward pull is applied to head 40 of connecting member 41 by inner sleeve 38 which creates a compressive force. Ball seat 28 is pressed downwardly into sealing element 26 until sealing element 26 engages a casing disposed in a well. A setting load is predetermined at which setting tool 34 will shear from the bottom shoe 20 and will be removed. A compressive force is applied to the top surface 30 of ball seat 28 by setting sleeve 36. The compressive force moves the ball seat 28 down relative to sealing element 26, and moves frac plug 15 to the set position shown in FIG. 3. Once the frac plug 15 is set, the setting tool 34 is detached and removed as shown in FIG. 4.

Once the setting tool 34 is removed friction between the casing and the sealing element 26 is relied upon to keep the frac plug 15 in the set position. Compression in the element 26 is additionally maintained by the wedge 24 and the slips 22. Single slip frac plugs generally only take differential pressure from above and as a result there is no need for bidirectional slips. However, with prior art single slip frac plugs as described there is a risk of the frac plug becoming unset as it relies on fiction between the sealing element and the inner diameter of the casing.

Figure 5:
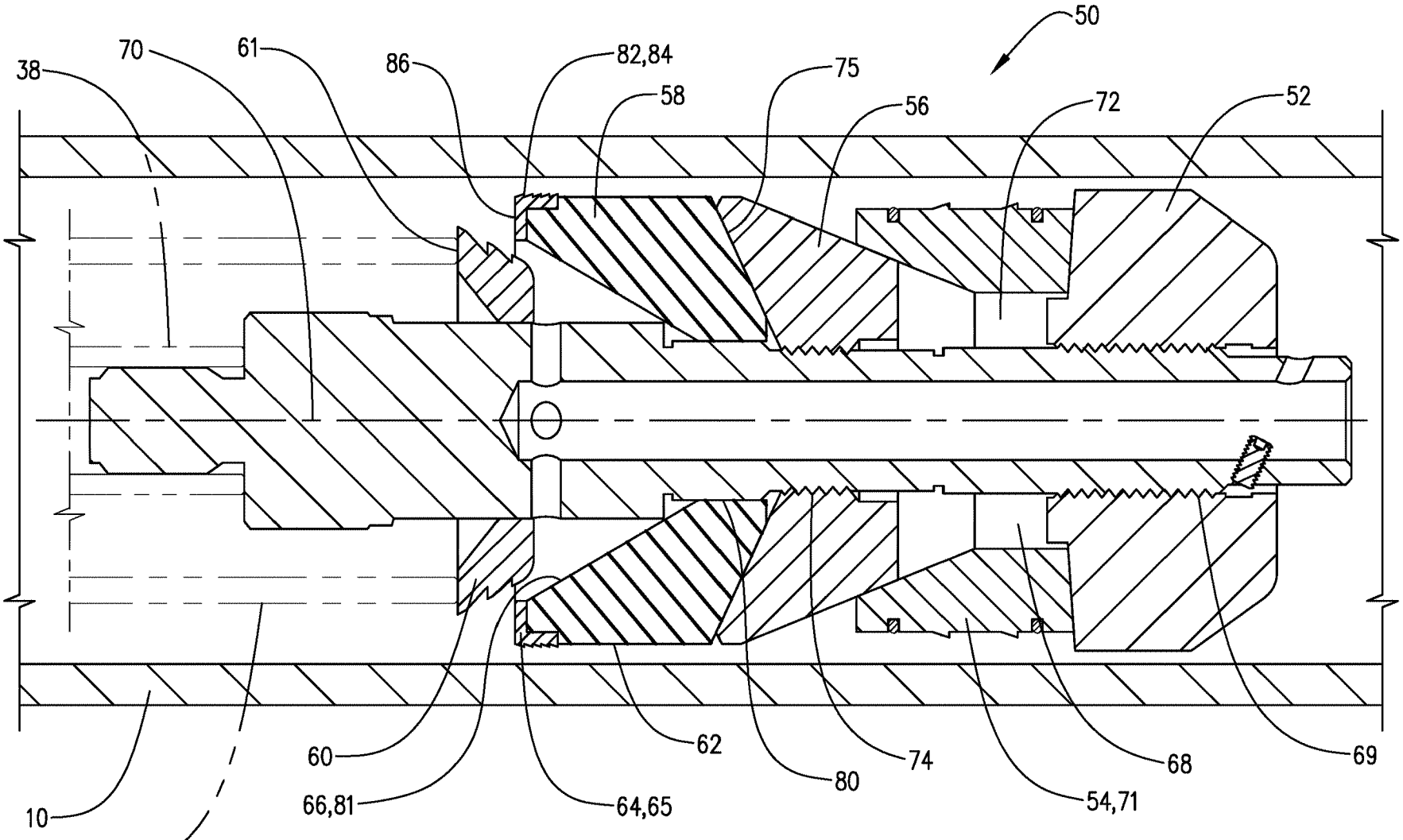
FIG. 5 is a cross section of a single slip frac plug of the current disclosure.
Figure 3:
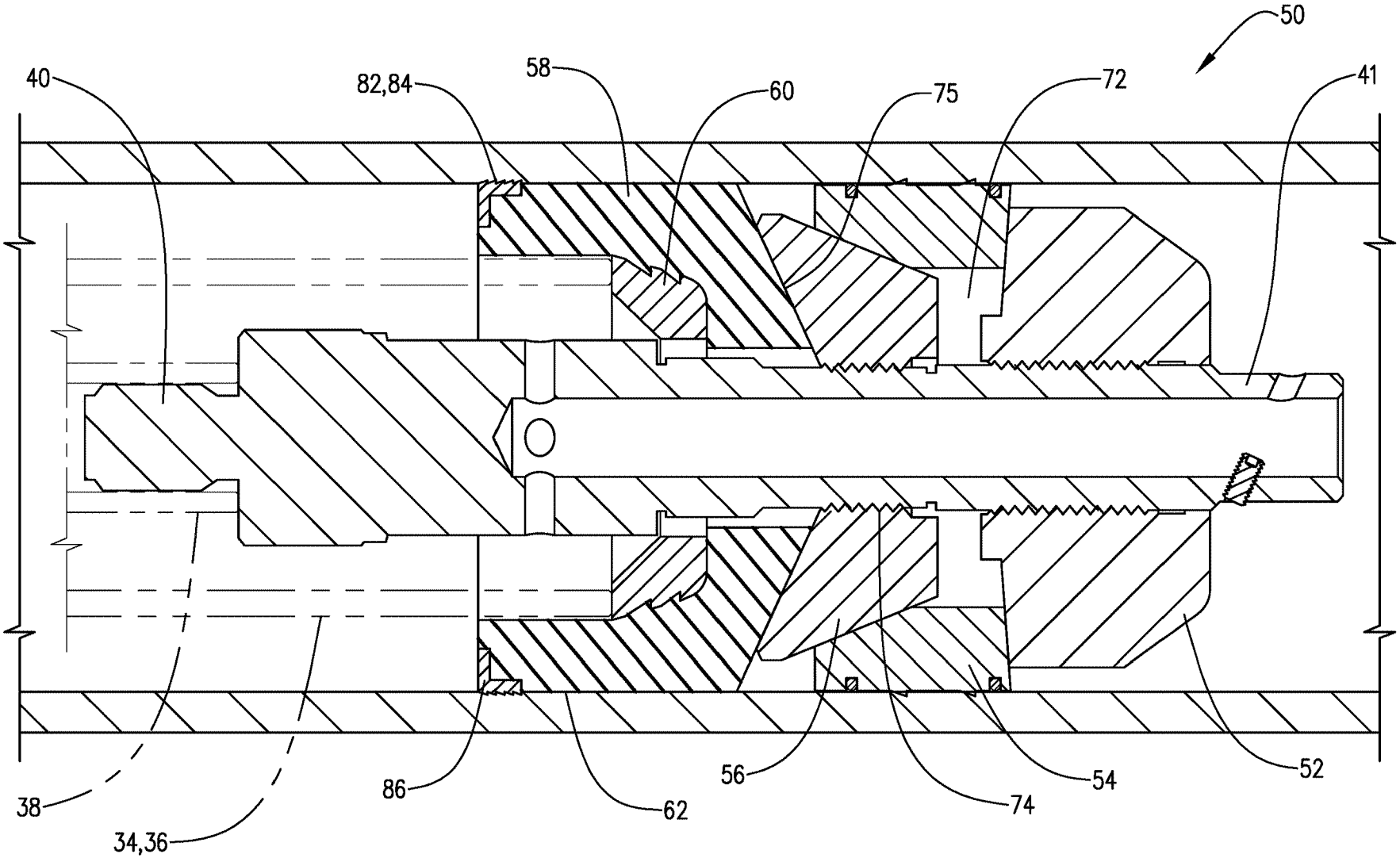
Figure 7:
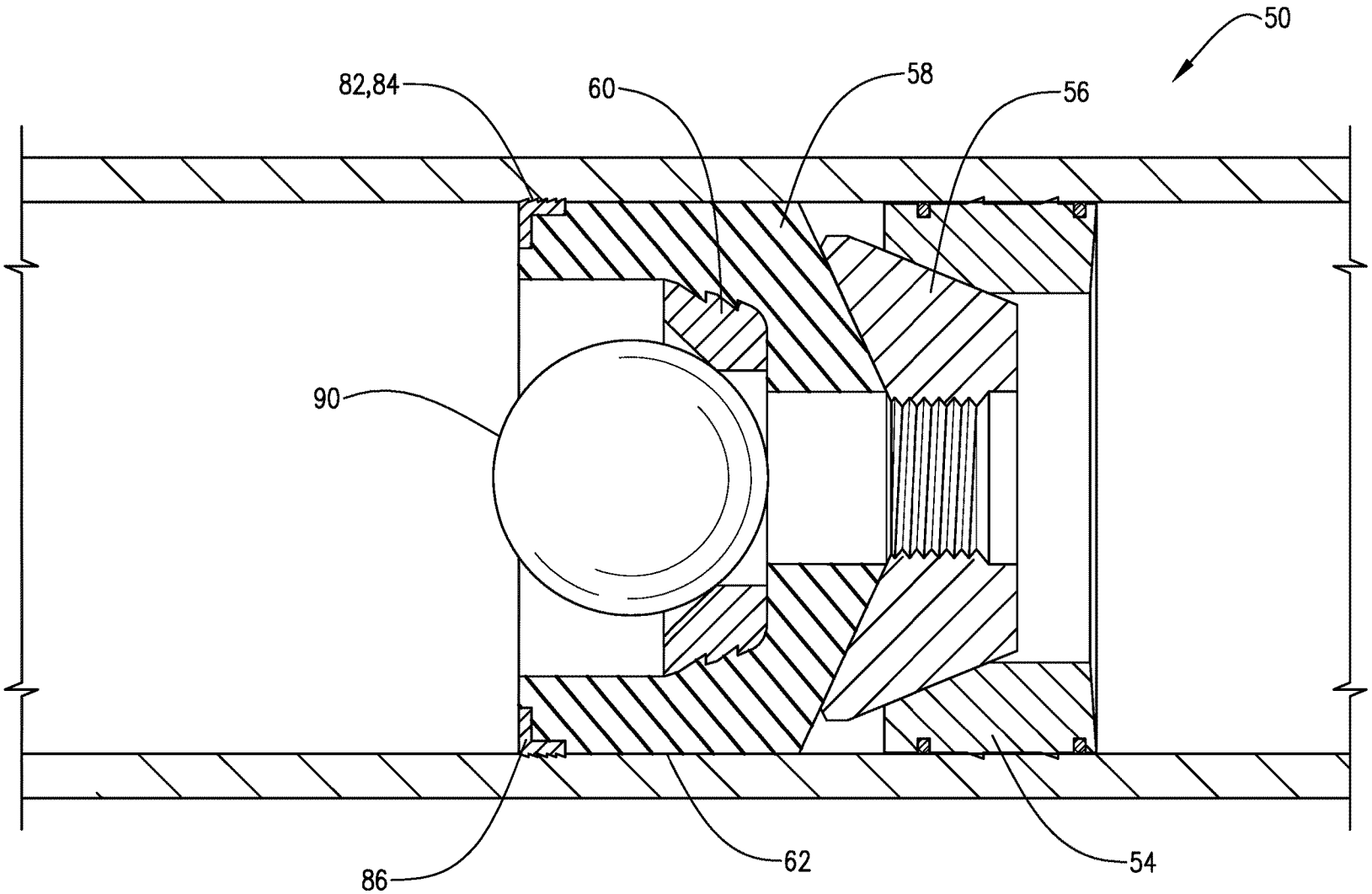
FIG. 7 is a cross section of the frac plug of FIG. 5 in a set position with the setting tool removed.

A frac plug 50 disclosed and claimed herein is a single slip frac plug 50. Single slip frac plug 50 is shown in FIGS. 5-7 and may be disposed in casing 10. Frac plug 50 may comprise a bottom shoe 52, a slip assembly 54 supported by the bottom shoe 52, a slip wedge 56 positioned above and in slidable relation to slip assembly 54 and a sealing element 58 supported by slip wedge 56. Slip ring assembly 54 is movable radially outwardly to engage the well in the set position of the frac plug 50. A ball seat 60 is utilized to move frac plug 50 and sealing element 58 from the unset position as shown in FIG. 5 to the set position shown in FIG. 6. Ball seat 60 has top surface 61. Frac plug 50 is moved to its set position with a setting tool 34. Setting tool 34 applies a compressive setting load as explained above.

Sealing element 58 has outer surface 62 which will engage casing 10 in the set position of frac plug 50. Sealing element 58 has top surface 64 at upper end 65 and has inner surface 66. Inner surface 66 is a sloped inner surface and slopes downwardly and radially inwardly from top surface 64. Frac plug 50 defines longitudinal central flow passage 68 therethrough and has longitudinal central axis 70. Bottom shoe 52 defines a central opening 69 therethrough which is a portion of longitudinal central flow passage 68. Connecting member 41 is detachably connected to bottom shoe 52 with shearable threads or by other means known in the art. Slip ring assembly 54 is of a type known in the art and may comprise a plurality of slip elements 71. Slip ring assembly 54 is supported by bottom shoe 52. Slip ring assembly 54 has an opening 72 therein through which connecting member 41 passes. Slip ring 54 is expandable and will grippingly engage casing 10 in the set position of the frac plug 50. Slip wedge 56 is positioned atop and is supported by slip ring assembly 54. Slip wedge 56 is positioned in slidable relation and may be detachably connected to the slip ring 54 such that axial relative movement between the two will urge slip assembly 54 outwardly into engagement with the casing 10. Slip wedge 56 has an opening 74 through which connecting member 41 passes. Slip wedge 56 has an outwardly sloping upper surface 75 from the opening 74 to an upper end 76 thereof. Slip wedge 56 may be detachably connected to setting tool 34 with shearable threads.

Sealing element 58 defines a generally cylindrical opening 80. Sloped inner surface 66 slopes upwardly and radially outwardly from opening 80. Inner surface 66 thus comprises a generally cylindrical portion 80 and sloped portion 81.

Frac plug 50 comprises a backup shoe 82 which may be a scored backup shoe 82. Backup shoe 82 is fixed to sealing element 58 and may be in one embodiment bonded thereto. Backup shoe 82 comprises an outer leg 84 and a top leg 86 connected thereto extending radially inwardly over at least a portion of top surface 64 of sealing element 58. Top leg 86 may be referred to as a cap 86. Cap 86 extends from outer leg 84 radially inwardly to cover at least a portion of top surface 64. Once single slip frac plug 50 has been lowered into the casing 10 to a desired location, setting sleeve 36 may be actuated to move the frac plug 50 from the unset to the set position. The operation of the setting tool 34 is as described above. Setting tool 34 is connected at a lower end thereof to bottom shoe 52. Inner sleeve 38 of the setting tool 34 is connected to head or adapter 40 of connecting member 41. Setting sleeve 36 engages ball seat 60. An upward pull is applied to head 40 of connecting member 41 by inner sleeve 38 which creates a downward force to compress frac plug 50. Ball seat 60 is pressed downwardly into sealing element 58 until sealing element 58 engages a casing disposed in a well 5. A setting load is predetermined at which connecting member 41 will shear from the bottom shoe 52 and will be removed. The downward force is applied to the top surface 61 of ball seat 60 by setting sleeve 36. The downward force moves the ball seat 60 down relative to sealing element 58, and moves frac plug 50 to the set position shown in FIG. 6. Once the frac plug 50 is set, the setting tool 34 is detached and removed as shown in FIG. 7.

Frac plug 50 with backup shoe 82 provides additional gripping strength over prior art single slip frac plugs. When frac plug 50 is moved to the set position, scored backup shoe 82 will engage and bite into casing 10, and will provide additional holding ability beyond that created by the friction between the sealing element 58 and casing 10 without the backup shoe 82. Once the frac plug 50 is moved to the set position the connection between the bottom shoe 52 and connecting member 41 will shear. The bottom shoe 52 will fall to the bottom of the well and the setting tool 34 will be removed from the well. A ball 90 may then be dropped into the well to seal against ball seat 60, and fracturing operations may occur thereabove.

Figure 8:
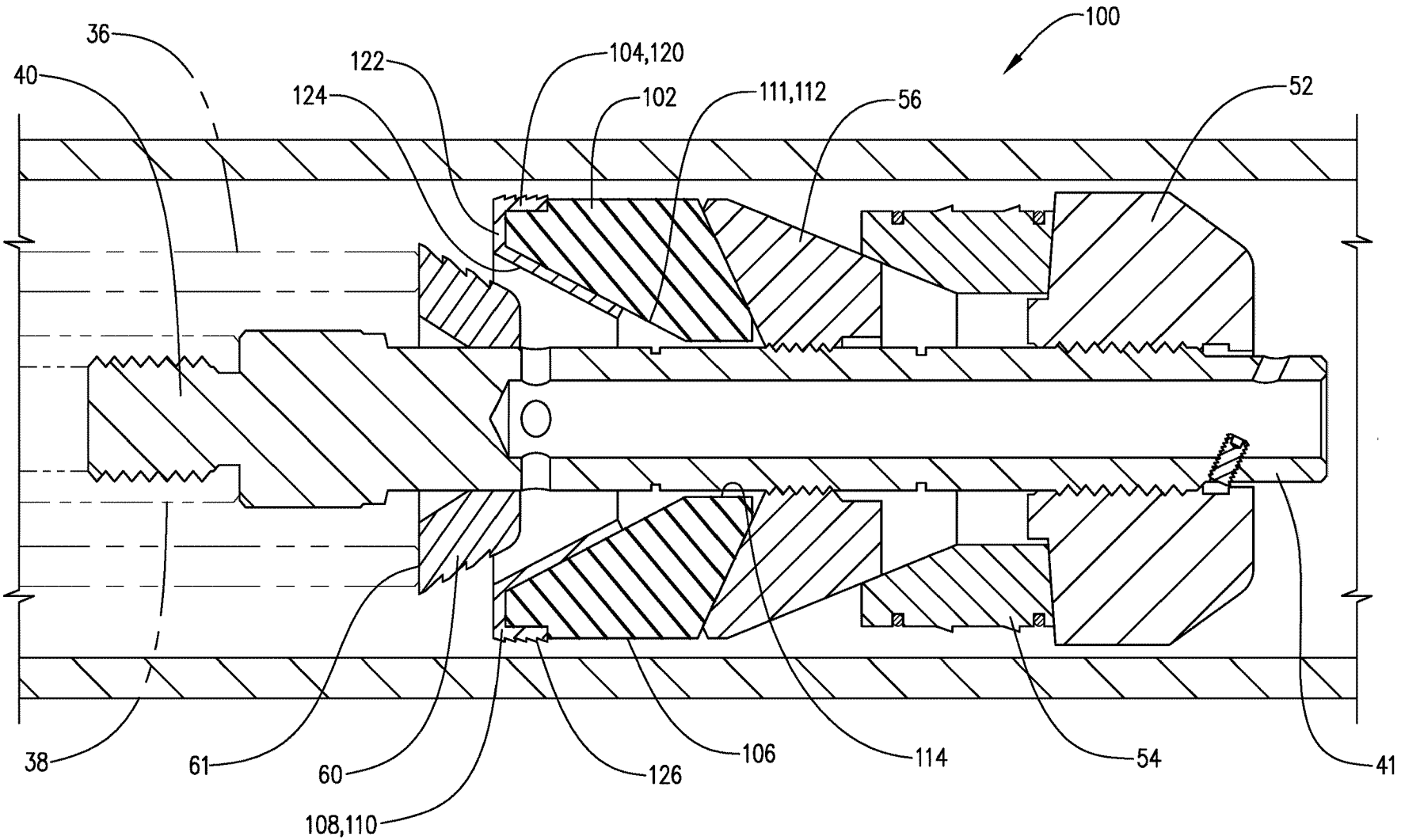
FIG. 8 is a cross section of an additional embodiment of a single slip frac plug.
Figure 3:
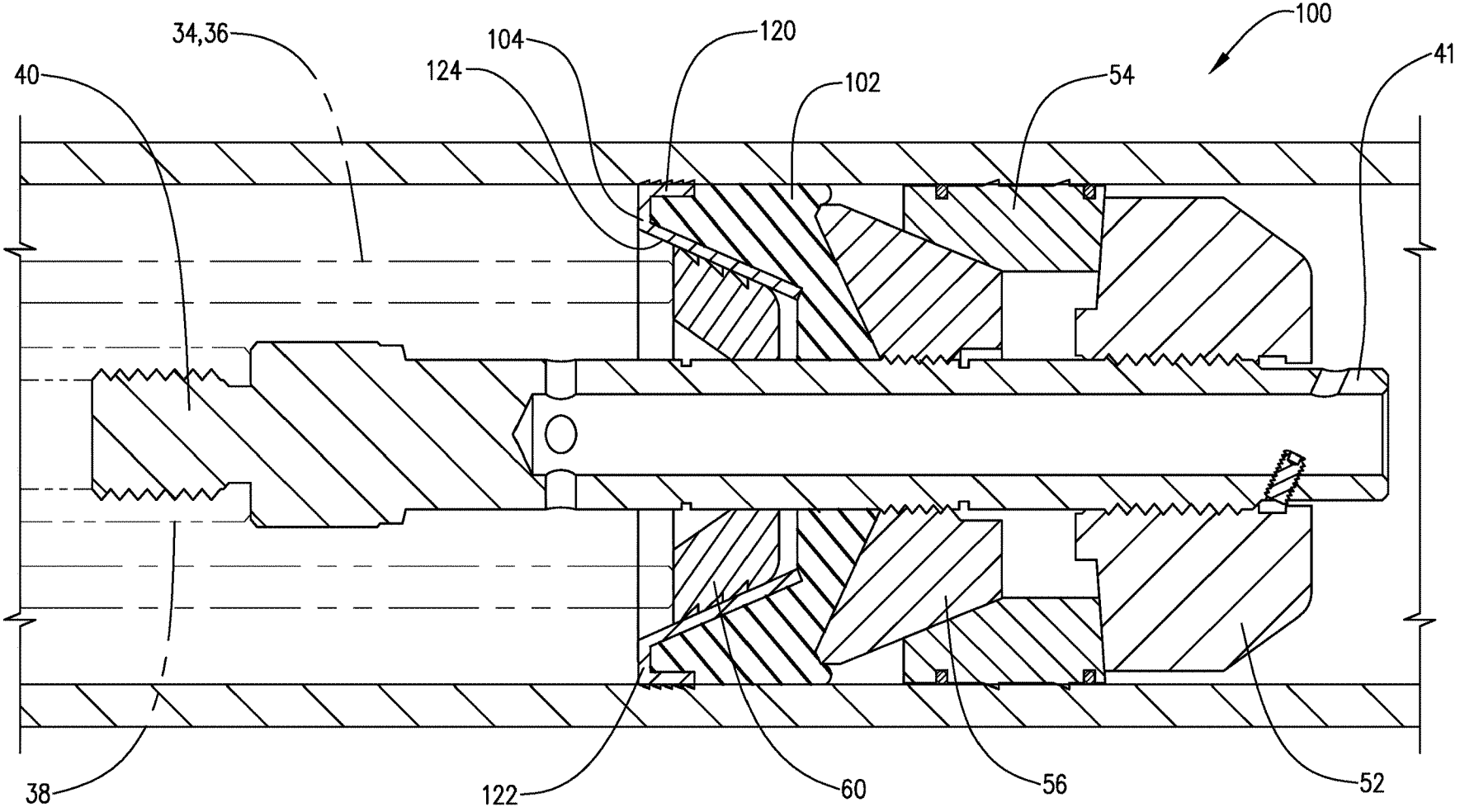
Figure 10:
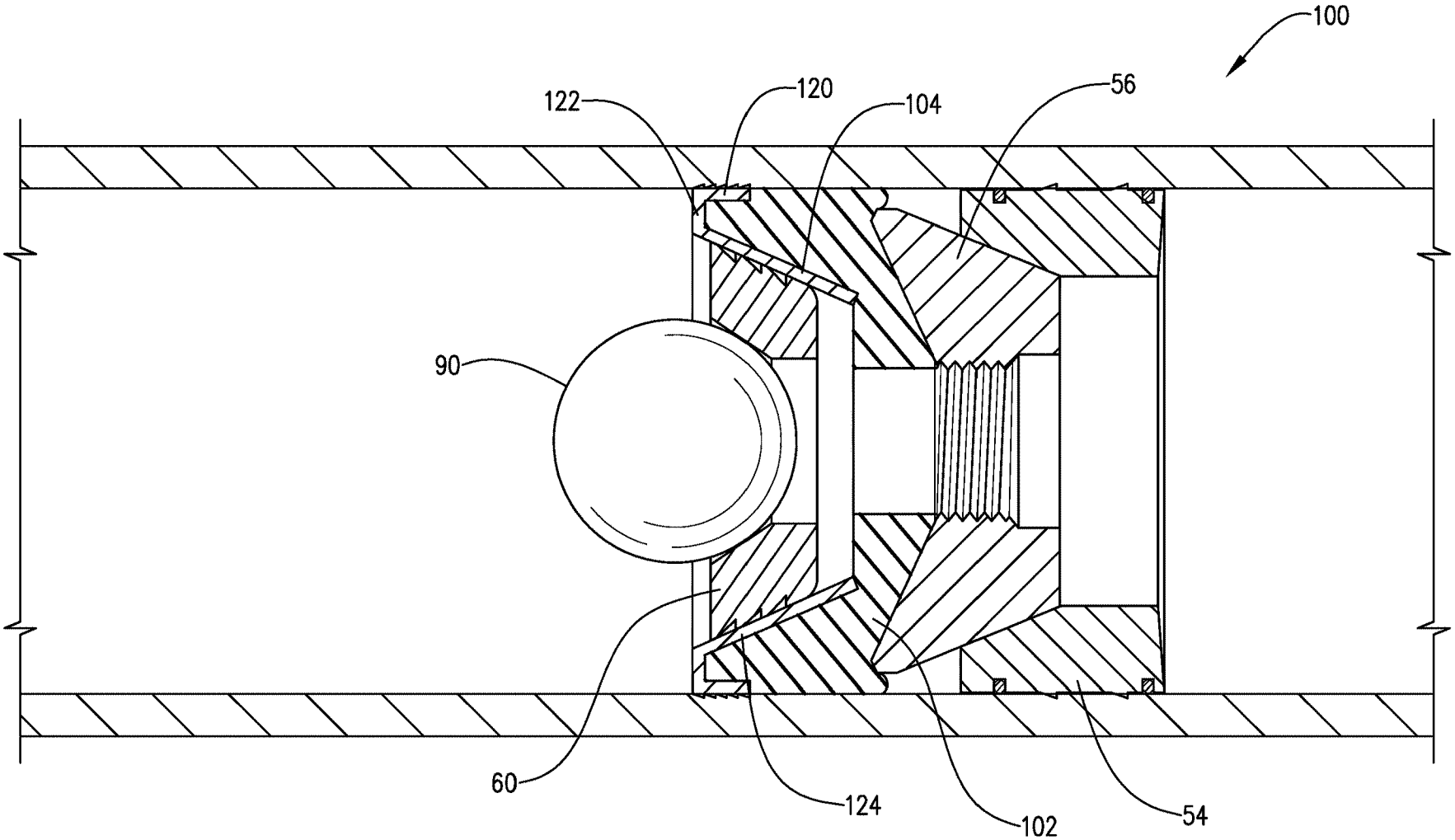
FIG. 10 is a cross section of the frac plug of FIG. 8 in a set position with the setting tool removed.

An additional embodiment of a frac plug 100 is shown in FIGS. 8-10. The components of frac plug 100 with the exception of the sealing element are generally like those described with respect to frac plug 50, and will be identified with the same numbers. Frac plug 100 comprises bottom shoe 52, slip assembly 54, slip wedge 56 and a sealing element 102. A ball seat 60 with top surface 61 is utilized to move frac plug 100 from the unset position shown in FIG. 8 to the set position shown in FIG. 9. A backup shoe 104 is fixed to sealing element 102. Frac plug 100 is moved to the set position with a setting tool 34 as described above.

Sealing element 102 has outer surface 106, top surface 108 at upper end 110 thereof and an inner surface 111. Inner surface 111 comprises a sloped inner surface 112 extending downwardly and radially inwardly from upper end 110 and a generally cylindrical surface 114 defining a generally cylindrical opening 116. Backup shoe 104 has outer leg 120, a cap 122 connected thereto and an inner wall, or inner leg 124 connected to cap 122. Cap 122 extends over at least a portion of top surface 108, and in the described embodiment completely covers top surface 108. Inner wall 124 extends downwardly and radially inwardly from cap 122 along at least portion of sloped inner surface 112 of sealing element 102.

Backup shoe 104 is a deformable backup shoe 104. The deformation of backup shoe 104 will provide an additional holding force over and above that which exists as a result of friction between sealing element 102 and casing 10. Outer leg 120 is a scored outer leg 120 with scored outer surface 126 so that in addition to the added holding force resulting from the plastically deformed backup shoe 104, the scored outer surface will grip into casing 10 to assist in holding frac plug 100 in its set position.

Once single slip frac plug 100 has been lowered into the casing 10 to a desired location, setting sleeve 36 may be actuated to move the frac plug 100 from the unset to the set position. The operation of the setting tool 34 is as described above. Connecting member 41 is connected at a lower end thereof to bottom shoe 52. Inner sleeve 38 of the setting tool 34 is connected to head or adapter 40 of connecting member 41. Setting sleeve 36 engages ball seat 60. An upward pull is applied to head 40 of connecting member 41 by inner sleeve 38 which creates a compressive force. Ball seat 60 is pressed downwardly into backup shoe 104, and more specifically into inner wall 124 of backup shoe 104. The force applied by ball seat 60 will cause backup shoe 104 to deform, and in the described embodiment to plastically deform. Inner wall 124 will be urged radially outwardly as sealing element 102 is likewise expanded as a result of the setting force applied by setting tool 34. The scored outer surface 126 will bite into casing 10 in the set position of the frac plug 100. A setting load is predetermined at which setting tool 34 will shear from the bottom shoe 52 and will be removed. The compressive force is applied to the top surface 61 of ball seat 60 by setting sleeve 36. The compressive force moves the ball seat 60 down relative to sealing element 58, and moves frac plug 50 to the set position shown in FIG. 9. Once the frac plug 100 is set, setting tool 34 is detached and removed as shown in FIG. 10. A ball 90 may then be dropped into the well to seal against ball seat 60, and fracturing operations may occur thereabove.

Backup shoe 104 provides additional gripping strength over prior art single slip frac plugs. When frac plug 100 is moved to the set position, backup shoe 104 will plastically deform to assist in keeping sealing element 102 expanded and set against casing 10. In addition, the scored outer surface 126 of backup shoe 104 will also add gripping strength. In this way, a more stable single slip frac plug is provided. Backup shoe 104 may be made from of any suitable material that will hold its shape once deformed, for example but not limited to a low yield ductile stainless steel, brass, low alloy steel, aluminum alloys, titanium alloys and magnesium alloys.

Figure 11:
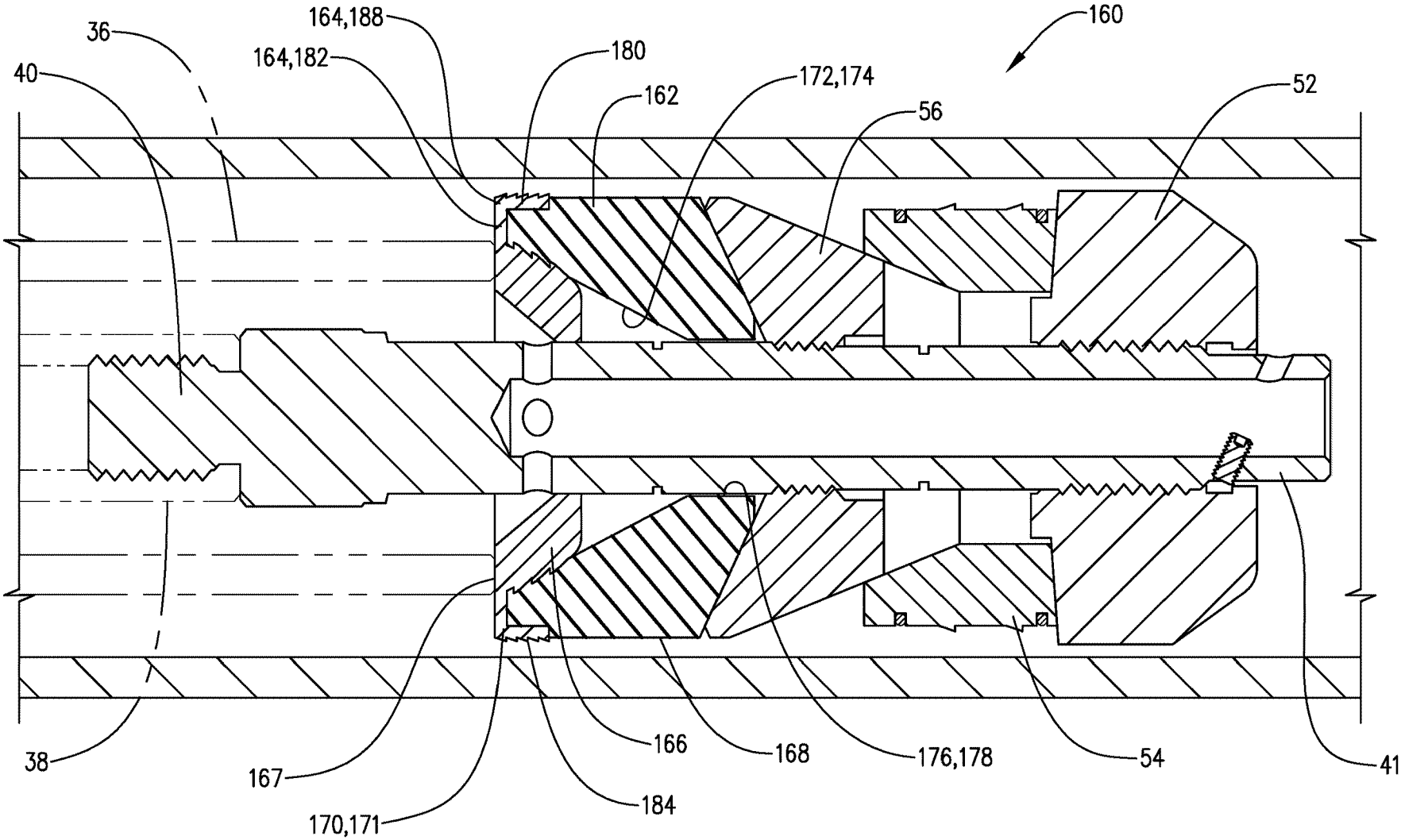
FIG. 11 is a cross section of an additional embodiment of a single slip frac plug.
Figure 12:
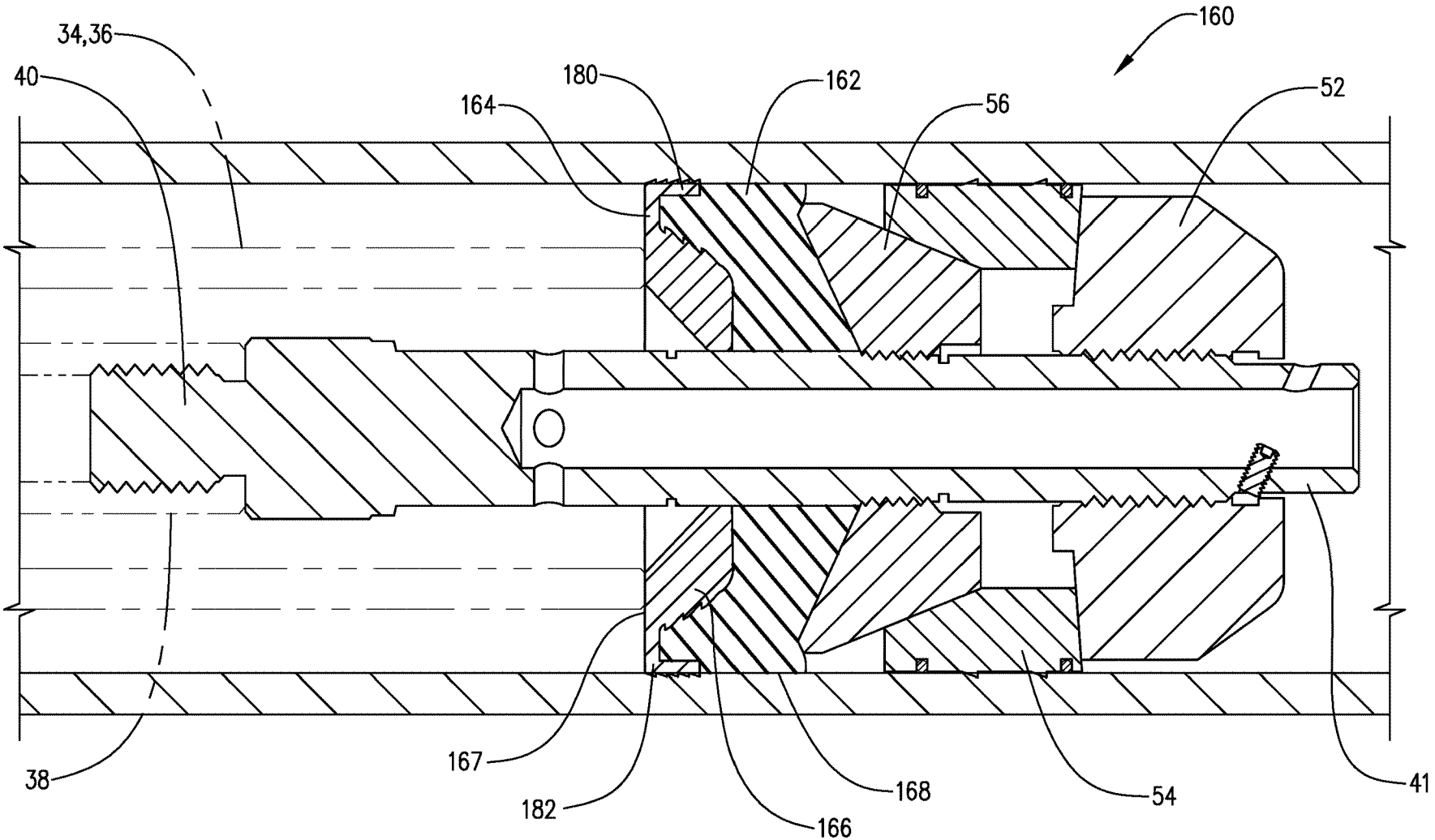
FIG. 12 is a cross section of the frac plug of FIG. 11 in a set position.
Figure 15:
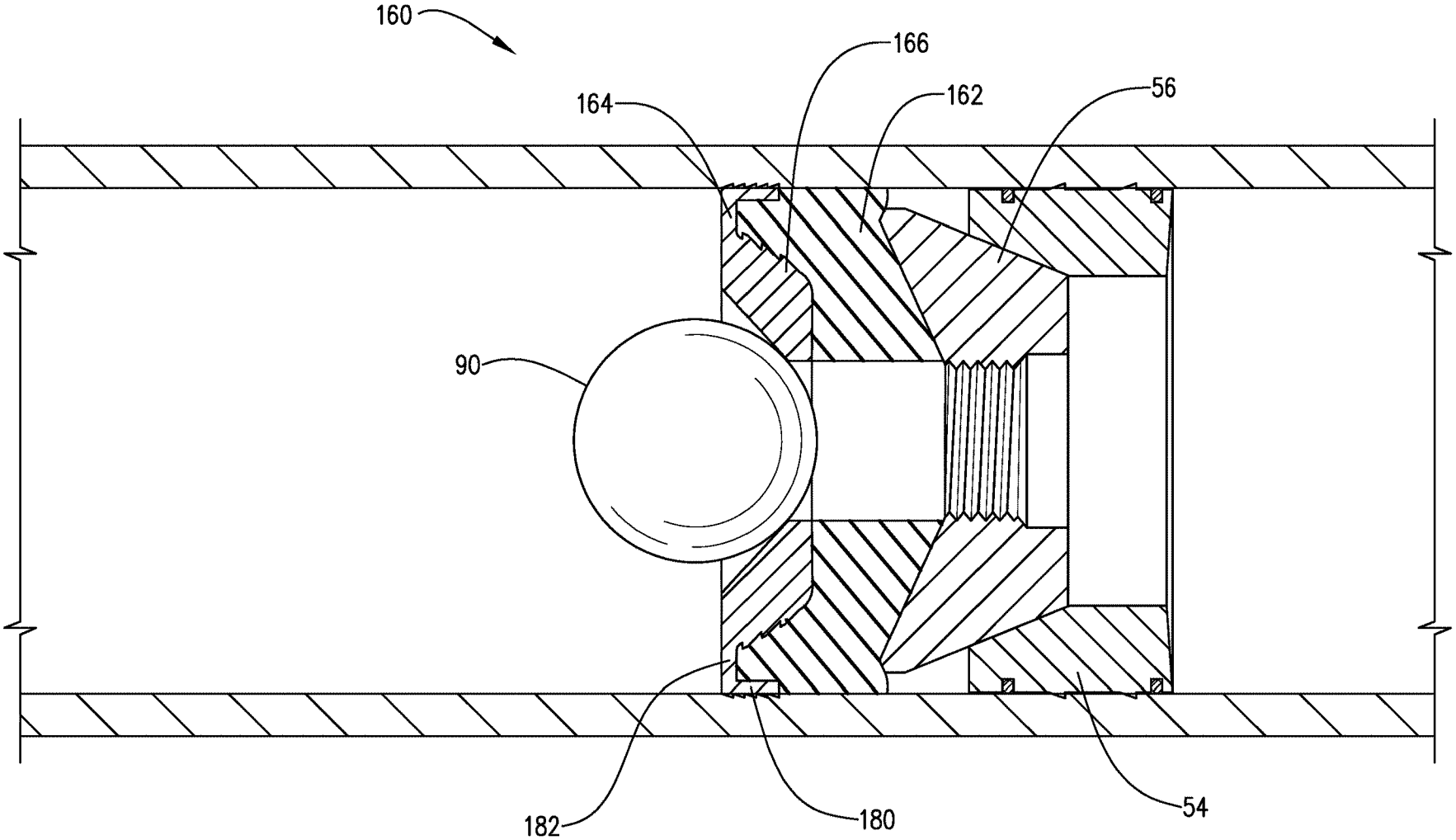

An additional embodiment of a frac plug 160 is shown in FIGS. 11-13. Frac plug 160 may be set with a typical setting tool like setting tool 34 shown in FIG. 1. The components of frac plug 160 with the exception of the sealing element and ball seat are generally like those described with respect to frac plug 50, and will be identified with the same numbers. Frac plug 160 comprises bottom shoe 52, slip assembly 54, slip wedge 56 and a sealing element 162. A backup shoe 164 is fixed to sealing element 162. A ball seat 166 with top surface 167 is utilized to move frac plug 160 from the unset position shown in FIG. 11 to the set position shown in FIG. 12. Ball seat 166 is an integrally connected ball seat such that it is integrally connected to backup shoe 164. Frac plug 160 is moved to the set position with a setting tool 34 as described above.

Sealing element 162 has outer surface 168, a top surface 170 at upper end 171 and an inner surface 172. Inner surface 172 comprises a sloping inner surface 174 that slopes downwardly and radially inwardly from top surface 170 and a cylindrical surface 176 extending downwardly from sloping inner surface 174. Cylindrical inner surface 176 defines a cylindrical opening 178 through which setting tool 34 extends.

Backup shoe 164 comprises an outer leg 180 and a cap 182 connected thereto and extending radially inwardly over at least a portion of top surface 170 of sealing element 162. In the described embodiment cap 182 completely covers top surface 170. Backup shoe 164 has a scored outer surface and more specifically has a scored outer surface 184 on outer leg 180 which extends downwardly along at least a portion of the outer surface of sealing element 162. Once single slip frac plug 160 has been lowered into the casing 10 to a desired location, setting sleeve 36 may be actuated to move the frac plug 160 from the unset to the set position. The operation of the setting tool 34 is as described above. Connecting member 41 is connected at a lower end thereof to bottom shoe 52. Inner sleeve 38 of the setting tool 34 is connected to head or adapter 40 of connecting member 41. Setting sleeve 36 engages ball seat 166. An upward pull is applied to head 40 of connecting member 41 by inner sleeve 38 which creates a compressive force. Ball seat 166 is pressed downwardly.

Ball seat 166 and backup shoe 164 comprise a ball seat unit 188, and in one embodiment a plastically deformable ball seat unit 188. Because ball seat 166 is connected to backup shoe 164, the downward force applied thereto will cause ball seat 166 to deform and rotate radially inwardly and decreasing the initial inner diameter of ball seat 166 to a smaller geometry as sealing element 162 is expanded to engage casing 10. The deformation of ball seat unit 188 will apply an outwardly directed force to sealing element 162 which will assist in keeping sealing element 162 expanded and set against casing 10. Likewise, the scored outer surface 184 will bite into casing 10 in the set position of the frac plug 100 and add gripping strength. Once the frac plug 160 is set, the setting tool 34 is detached and removed as shown in FIG. 13. A ball 90 may then be dropped into the well to seal against ball seat 166, and fracturing operations may occur thereabove. Ball seat unit 188 may be made of any suitable material that will hold its shape once deformed, for example but not limited to a low yield stainless steel low yield ductile stainless steel, brass, low alloy steel, aluminum alloys, titanium alloys and magnesium alloys.

Embodiments include:

Embodiment 1. A frac plug defining a central passage therethrough and movable from an unset to a set position in a well casing comprising: a bottom shoe; a single slip ring assembly supported by the bottom shoe; a slip wedge positioned in slidable relationship to the single slip assembly; a sealing element supported by the slip wedge and expandable radially outwardly to seal against the well in the set position of the frac plug; a ball seat movable axially relative to the sealing element to move the sealing element from the unset to the set position, and a scored backup shoe fixed to the sealing element, the scored backup shoe engaging the well casing in the set position of the frac plug.

Embodiment 2. The frac plug of embodiment 1, the backup shoe comprising an outer leg extending along at least a portion of an outer surface of the sealing element and a cap connected to and extending radially inwardly from the outer leg, the outer leg having the scored outer surface.

Embodiment 3. The frac plug of either of embodiments 1 or 2, the backup shoe comprising a deformable backup shoe.

Embodiment 4. The frac plug of either of embodiments 2 or 3, wherein the cap completely covers an upper surface of the sealing element.

Embodiment 5. The frac plug of the embodiment of any of claims 2-4, the backup shoe further comprising an inner leg connected to and extending downwardly from the cap along a sloped inner surface of the sealing element.

Embodiment 6. The frac plug of embodiment 1, wherein the ball seat is connected to the scored backup shoe.

Embodiment 7. The frac plug of embodiment 6, the ball seat being integrally connected to the cap.

Embodiment 8. The frac plug of any of embodiments 1-7 further comprising a setting tool removably connected to the bottom shoe and engageable with the ball seat, the setting tool configured to apply a compression load to the frac plug to move the frac plug from the unset to the set position.

Embodiment 9. A frac plug movable from an unset to a set position in a well casing with a setting tool comprising: a single slip ring movable radially outwardly to engage the well casing in the set position of the frac plug; a slip wedge slidable relative to the single slip ring to urge the single slip ring radially outwardly; a sealing element supported by the slip wedge and expandable radially outwardly to engage the well casing in the set position of the frac plug; a ball seat insertable into an upper opening of the sealing element; and a backup shoe integrally connected to the ball seat.

Embodiment 10. The frac plug of embodiment 9, the backup shoe comprising a plastically deformable backup shoe.

Embodiment 11. The frac plug of either of embodiments 9 or 10, the backup shoe having a scored outer surface engageable with the well casing.

Embodiment 12. The frac plug of any of embodiments 9-11, the backup shoe comprising an outer leg positioned between at least a portion of the sealing element and the well casing; and a cap connected to the outer leg and positioned on an upper surface of the sealing element, the cap being connected to the ball seat.

Embodiment 13. The frac plug of any of embodiments 9-11 further comprising a bottom shoe positioned below and supporting the single slip ring.

Embodiment 14. A frac plug movable from an unset to a set position in a well having a casing therein comprising: a bottom shoe; a single slip ring supported by the bottom shoe and radially expandable to grippingly engage a wellbore wall; a slip wedge positioned above the slip ring, the slip ring axially movable relative to the slip wedge; a radially outwardly expandable sealing element supported by the slip wedge; a deformable backup shoe at an upper end of the sealing element, the deformable backup shoe comprising a cap covering at least a portion of a top surface of the sealing element and an outer leg extending along at least a portion of the outer surface of the sealing element; and a ball seat insertable into the radially outwardly expandable sealing element.

Embodiment 15. The frac plug of embodiment 14, the backup shoe comprising an inner wall connected to the cap and extending downwardly therefrom to cover at least a portion of a sloped inner surface of the sealing element.

Embodiment 16. The frac plug of embodiment 15, wherein the ball seat engages the inner wall of the backup shoe to move the frac plug from the unset to the set position.

Embodiment 17. The frac plug of any of embodiments 14-16, wherein the ball seat deforms the backup shoe when the frac plug is moved from the unset to the set position.

Embodiment 18. The frac plug of embodiment 14, the ball seat being connected to the cap of the backup shoe.

Embodiment 19. The frac plug of any of embodiments 14-18, the backup shoe having a scored outer surface in engagement with the casing in the set position of the frac plug.

Embodiment 20. The frac plug of any of embodiments 14-19, further comprising a setting tool detachably connected to the bottom shoe and operable to apply a downward force to the backup shoe.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A frac plug defining a central passage therethrough and movable from an unset to a set position in a well casing comprising:

a bottom shoe;

a single slip ring assembly supported by the bottom shoe;

a slip wedge positioned in slidable relationship to the single slip ring assembly;

a sealing element supported by the slip wedge and expandable radially outwardly to seal against the well in the set position of the frac plug;

a ball seat movable axially relative to the sealing element and engageable with the sealing element to move the sealing element from the unset to the set position; and a scored backup shoe fixed to an upper end of the sealing element, the scored backup shoe engaging the well casing in the set position of the frac plug.

2. The frac plug of claim 1, the backup shoe comprising an outer leg extending along at least a portion of an outer surface of the sealing element and a cap connected to and extending radially inwardly from the outer leg, the outer leg having the scored outer surface.

3. The frac plug of claim 2, wherein the cap completely covers an upper surface of the sealing element.

4. The frac plug of claim 2, the backup shoe further comprising an inner leg connected to and extending downwardly from the cap along a sloped inner surface of the sealing element.

5. The frac plug of claim 2, wherein the ball seat is connected to the scored backup shoe.

6. The frac plug of claim 2, the ball seat being integrally connected to the cap.

7. The frac plug of claim 1, the backup shoe comprising a deformable backup shoe.

8. The frac plug of claim 1, further comprising a setting tool removably connected to the bottom shoe and engageable with the ball seat, the setting tool configured to apply a compression load to the frac plug to move the frac plug from the unset to the set position.

9. A frac plug movable from an unset to a set position in a well casing with a setting tool comprising:

a single slip ring movable radially outwardly to engage the well casing in the set position of the frac plug;

a slip wedge slidable relative to the single slip ring to urge the single slip ring radially outwardly;

a sealing element supported by the slip wedge and expandable radially outwardly to engage the well casing in the set position of the frac plug;

a ball seat insertable into an upper opening of the sealing element; and a backup shoe integrally connected to the ball seat.

10. The frac plug of claim 9, the backup shoe comprising a plastically deformable backup shoe.

11. The frac plug of claim 9, the backup shoe having a scored outer surface engageable with the well casing.

12. The frac plug of claim 9, the backup shoe comprising:

an outer leg positioned between at least a portion of the sealing element and the well casing; and a cap connected to the outer leg and positioned on an upper surface of the sealing element, the cap being connected to the ball seat.

13. The frac plug of claim 9 further comprising a bottom shoe positioned below and supporting the single slip ring.

14. A frac plug movable from an unset to a set position in a well having a casing therein comprising:

a bottom shoe;

a single slip ring supported by the bottom shoe and radially expandable to grippingly engage a wellbore wall;

a slip wedge positioned above the slip ring, the slip ring axially movable relative to the slip wedge;

a radially outwardly expandable sealing element supported by the slip wedge;

a deformable backup shoe fixed to the sealing element, the deformable backup shoe comprising a cap covering at least a portion of a top surface of the sealing element and an outer leg extending along at least a portion of an outer surface of the sealing element, the backup shoe having a scored outer surface in engagement with the casing in the set position of the frac plug; and a ball seat insertable into the radially outwardly expandable sealing element.

15. The frac plug of claim 14, the backup shoe comprising an inner wall connected to the cap and extending downwardly therefrom to cover at least a portion of a sloped inner surface of the sealing element.

16. The frac plug of claim 15, wherein the ball seat engages the inner wall of the backup shoe to move the frac plug from the unset to the set position.

17. The frac plug of claim 16, wherein the ball seat deforms the backup shoe when the frac plug is moved from the unset to the set position.

18. The frac plug of claim 14, the ball seat being connected to the cap of the backup shoe.

19. The frac plug of claim 14, further comprising a setting tool detachably connected to the bottom shoe and operable to apply a downward force to the backup shoe.

* * * * *